US006347606B1

(12) United States Patent
Tanaka et al.

(10) Patent No.: US 6,347,606 B1
(45) Date of Patent: Feb. 19, 2002

(54) VALVE OPERATING SYSTEM IN INTERNAL COMBUSTION ENGINE

(75) Inventors: Chikara Tanaka; Hiromu Nakamura; Noriyuki Yamada, all of Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/745,993

(22) Filed: Dec. 26, 2000

(30) Foreign Application Priority Data

Dec. 28, 1999 (JP) ..... 11-375569

(51) Int. Cl.[7] ..... F01L 1/18

(52) U.S. Cl. ..... 123/90.16; 123/90.39; 123/90.42

(58) Field of Search ..... 123/90.15, 90.16, 123/90.39, 90.42, 90.44, 90.5; 74/519, 559

(56) References Cited

U.S. PATENT DOCUMENTS

| | | | | |
|---|---|---|---|---|
| 5,460,130 A | * | 10/1995 | Fukuzawa et al. | 123/90.16 |
| 5,515,820 A | * | 5/1996 | Sugimoto et al. | 123/90.16 |
| 5,845,614 A | * | 12/1998 | Tanaka et al. | 123/90.16 |
| 5,960,754 A | * | 10/1999 | Sugimoto et al. | 123/90.15 |
| 5,979,379 A | * | 11/1999 | Sato et al. | 123/90.16 |
| 6,186,102 B1 | * | 2/2001 | Kosuge et al. | 123/90.16 |

FOREIGN PATENT DOCUMENTS

| | | |
|---|---|---|
| JP | 11-13440 | 1/1999 |

* cited by examiner

*Primary Examiner*—Weilun Lo
(74) *Attorney, Agent, or Firm*—Armstrong, Westerman, Hattori, McLeland & Naughton, LLP

(57) ABSTRACT

A valve operating system in an internal combustion engine includes a switchover pin which is movable between an associatively operating position where adjacent ones of rocker arms are operated in association with each other, and an associative-operation releasing position where the associative-operation is released, the switchover pin receiving at axially opposite ends thereof a hydraulic pressure force acting toward the associatively operating position and a spring force acting toward the associative-operation releasing position, a cylindrical roller shaft which is fixed to one of the adjacent rocker arms, and into which the switchover pin is slidably fitted in response to the movement thereof toward the associatively operating position, and a roller rotatably carried on the roller shaft to come into rolling contact with a cam provided on a camshaft. In this valve operating system, at least one of axially opposite end surfaces of the roller shaft formed of a material harder than that of the one rocker arm, which receives the switchover pin, protrudes from a side surface of the one rocker arm. Thus, a wear powder can be prevented from entering into the roller shaft, thereby ensuring the smooth switching-over operation of the switchover pin.

3 Claims, 9 Drawing Sheets

VALVE OPERATING SYSTEM IN INTERNAL COMBUSTION ENGINE

BACKGROUND OF THE INVENTION

1. Field of the Invention

The present invention relates to a valve operating system in an internal combustion engine, comprising a switchover pin which is movable between an associatively operating position where adjacent ones of rocker arms are operated in association with each other, and an associative-operation releasing position where the associative-operation is released, the switchover pin receiving at axially opposite ends thereof a hydraulic pressure force acting toward the associatively operating position and a spring force acting toward the associative-operation releasing position, a cylindrical roller shaft which is fixed to one of the adjacent rocker arms, and into which the switchover pin is slidably fitted in response to the movement thereof toward the associatively operating position, and a roller rotatably carried on the roller shaft to come into rolling contact with a cam provided on a camshaft.

2. Description of the Related Art

Such a valve operating system is conventionally known from Japanese Patent Application Laid-open No. 11-13440 and the like, for example.

Such valve operating system is designed such that the operational characteristic of an engine valve is changed in accordance with the operational condition of an engine by switching-over a state in which adjacent rocker arms are swung independently from each other, and a state in which the adjacent rocker arms are swung in association with each other, by operating the switchover pin between the associatively operating position and the associative-operation releasing position. However, the weights of the rocker arms are increased due to the provision of such a switchover mechanism. Therefore, it is a conventional practice that each of the rocker arms is formed of an aluminum alloy to have a decreased weight.

It should be noted here that there is a possibility that the hydraulic pressure force for biasing the switchover pin toward the associatively operating position may be varied. When the hydraulic pressure force is varied in a state in which the switchover pin has been moved to the associative-operation releasing position with the hydraulic pressure force lowered, the switchover pin may be moved toward the one rocker arm against the spring force in some cases. In the known system, however, the end surface of the roller shaft fixed to the one rocker arm is disposed flush with the opposite side surfaces of the one rocker arm, so that the switchover pin is slidably fitted into the roller shaft in response to the movement thereof toward the associatively operating position. When the adjacent rocker arms are swung relative to each other in their states in which their associative-operations have been released, there is a possibility that the end surface of the switchover pin may also be brought into sliding contact with the side surface of the one rocker arm, and a wear powder produced due to the sliding contact of the switchover pin with the rocker arm may enter into the roller shaft to impede the smooth switching-over operation of the switchover pin.

SUMMARY OF THE INVENTION

The present invention has been accomplished in view of the above circumstances, and an object of the present invention is to provide a valve operating system in an internal combustion engine, wherein a wear powder can be prevented from entering into the roller shaft, thereby ensuring the smooth switching-over operation of the switchover pin.

To achieve the above object, according to a first aspect and feature of the present invention, there is provided a valve operating system in an internal combustion engine, comprising a switchover pin which is movable between an associatively operating position where adjacent ones of rocker arms are operated in association with each other, and an associative-operation releasing position where the associative-operation is released, the switchover pin receiving at axially opposite ends thereof a hydraulic pressure force acting toward the associatively operating position and a spring force acting toward the associative-operation releasing position, a cylindrical roller shaft which is fixed to one of the adjacent rocker arms, and into which the switchover pin is slidably fitted in response to the movement thereof toward the associatively operating position, and a roller rotatably carried on the roller shaft to come into rolling contact with a cam provided on a camshaft, wherein at least one of axially opposite end surfaces of the roller shaft formed of a material harder than that of the one rocker arm, which receives the switchover pin, protrudes from a side surface of the one rocker arm.

With such arrangement of the first feature, the end surface of the roller shaft fixed to one of the rocker arms, which receives the switchover pin, i.e., the end surface adjacent the other rocker arm protrudes from the side surface of the one rocker arm. Therefore, even if the hydraulic pressure force is varied during relative swinging movements of the adjacent rocker arms, the end surface of the switchover pin cannot be brought into sliding contact with the side surface of the one rocker arm, and is brought into sliding contact with the end surface of the roller shaft. The roller shaft is made of the material harder than that of the one rocker arm and hence, it is possible to prevent the generation of a wear powder due to the sliding contact of the roller shaft and the switchover pin to the utmost, so that the wear powder cannot enter into the roller shaft, thereby ensuring the smooth switching-over operation of the switchover pin.

According to a second aspect and feature of the present invention, in addition to the first feature, an outside diameter of the roller shaft is set so that a change in position of the switchover pin relative to the roller shaft in response to the relative swinging movements of the adjacent rocker arms in a state in which the switchover pin is in the associative-operation releasing position, occurs within a range defined by an outer periphery of the roller shaft. With such arrangement of the second feature, during the relative swinging movements of the adjacent rocker arms, the change in relative position of the switchover pin relative to the roller shaft occurs within the range defined by the outer periphery of the roller shaft fixed to the one rocker arm. Therefore, even if the hydraulic pressure force is varied during the relative swinging movements of the adjacent rocker arms, the end surface of the switchover pin cannot be separated from the end surface of the roller shaft to come into sliding contact with the side surface of the one rocker arm, and is brought into sliding contact with the end surface of the roller shaft.

According to a third aspect and feature of the present invention, there is provided a valve operating system in an internal combustion engine, comprising a switchover pin which is movable between an associatively operating position where adjacent ones of rocker arms are operated in association with each other, and an associative-operation releasing position where the associative-operation is released, the switchover pin receiving at axially opposite ends thereof a hydraulic pressure force acting toward the associatively operating position and a spring force acting toward the associative-operation releasing position, a cylindrical roller shaft which is fixed to one of the adjacent rocker arms, and into which the switchover pin is slidably fitted in response to the movement thereof toward the associatively operating position, and a roller rotatably carried on the roller shaft to come into rolling contact with a cam provided on a camshaft, wherein an outside diameter of the roller shaft formed of a material harder than that of the one rocker arm is set so that a change in position of the switchover pin relative to the roller shaft in response to the relative swinging movements of the adjacent rocker arms in a state in which the switchover pin is in the associative-operation releasing position, occurs within a range defined by an outer periphery of the roller shaft.

With such arrangement of the third feature, during the relative swinging movements of the adjacent rocker arms, the change in position of the switchover pin relative to the roller shaft occurs within the range defined by the outer periphery of the roller shaft fixed to the one rocker arm. Therefore, even if the hydraulic pressure force is varied during the relative swinging movements of the adjacent rocker arms, the end surface of the switchover pin cannot be separated from the end surface of the roller shaft to come into sliding contact with the side surface of the one rocker arm, and is brought into sliding contact with the end surface of the roller shaft. The roller shaft is made of the material harder than that of the one rocker arm and hence, it is possible to prevent the generation of a wear powder due to the sliding contact of the roller shaft and the switchover pin to the utmost, so that the wear powder cannot enter into the roller shaft, thereby ensuring the smooth switching-over operation of the switchover pin.

The above and other objects, features and advantages of the invention will become apparent from the following description of the preferred embodiment taken in conjunction with the accompanying drawings.

BRIEF DESCRIPTION OF THE DRAWINGS

FIGS. 1 to 7 show a first embodiment of the present invention, wherein

FIG. 1 is a partial vertical sectional view of an internal combustion engine;

FIG. 2 is a plan view taken in the direction of an arrow 2 in FIG. 1;

FIG. 3 is an enlarged view taken along a line 3—3 in FIG. 1;

FIG. 4 is a sectional view taken along a line 4—4 in FIG. 3;

FIG. 5 is an enlarged sectional view taken along a line 5—5 in FIG. 1;

FIG. 6 is an enlarged sectional view taken along a line 6—6 in FIG. 3;

FIG. 7 is a sectional view for explaining a press-fit margin for a roller shaft press-fitted into a rocker arm;

DESCRIPTION OF THE PREFERRED EMBODIMENTS

Figure 1:
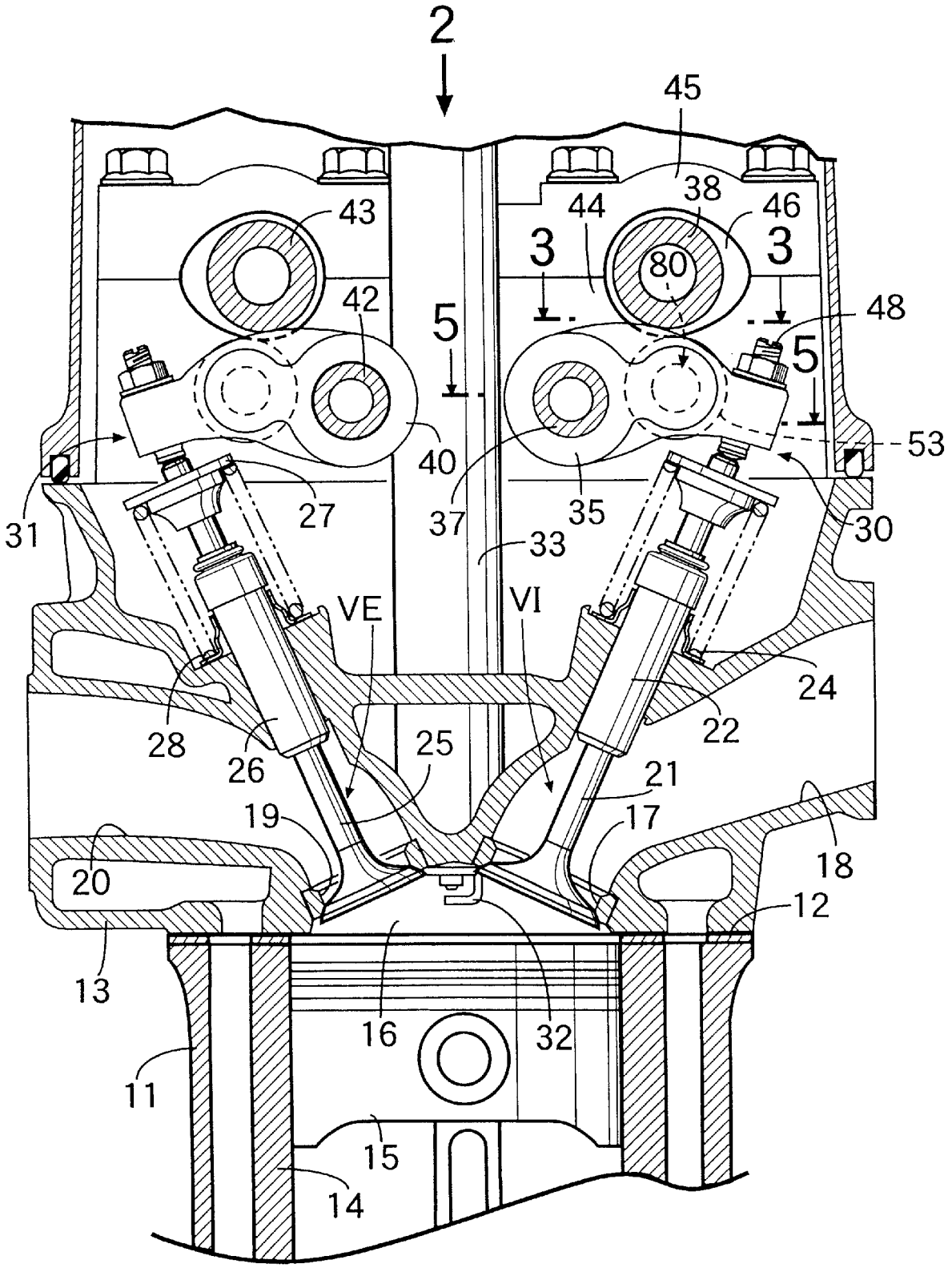
Figure 2:
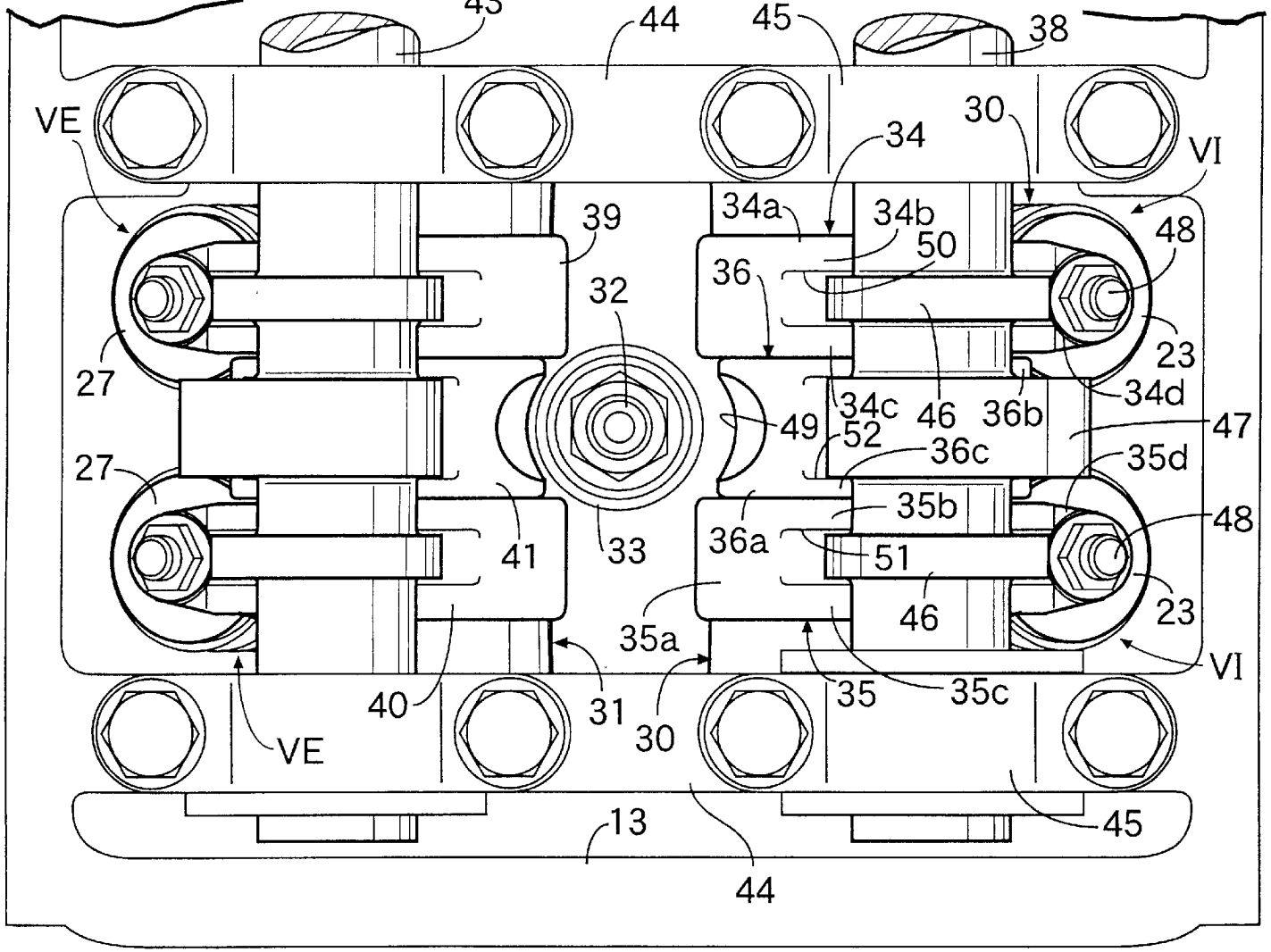

The present invention will be described by way of a first embodiment with reference to FIGS. 1 to 7. Referring first to FIGS. 1 and 2, a multi-cylinder internal combustion engine includes a cylinder block 11, and a cylinder head 13 coupled to an upper portion of the cylinder block 11 through a gasket 12. A piston 15 is slidably received in each of cylinders 14 provided in the cylinder block 11. A combustion chamber 16 is defined in every cylinder by the cylinder block 11, the cylinder head 13 and each of the pistons 15.

Provided in the cylinder head 13 for every cylinder are a pair of intake valve bores 17 facing one side of a ceiling surface of the combustion chamber 16, an intake port 18 which is connected commonly to the intake valve bores 17 and opens into one side surface of the cylinder head 13 (a right side surface as viewed in FIG. 1), a pair of exhaust valve bores 19 facing the other side of the ceiling surface of the combustion chamber 16, and an exhaust port 20 which is connected commonly to the exhaust valve bores 19 and opens into the other side surface (a left side surface as viewed in FIG. 1) of the cylinder head 13.

Stems 21 of intake valves VI, VI capable of opening and closing the intake valve bores 17, respectively, are slidably received in guide tubes 22 mounted in the cylinder head 13, and valve springs 24 for biasing the intake valves VI, VI upwards, i.e., in a valve closing direction are mounted between the cylinder head 13 and retainers 23, 23 mounted at upper ends of the stems 21 protruding upwards from the guide tubes 22. Stems 25 of exhaust valves VE, VE as engine valves capable of opening and closing the exhaust valve bores 19, respectively, are slidably received in guide tubes 26 mounted in the cylinder head 13, and valve springs 28 for biasing the exhaust valves VE, VE upwards, i.e., in a valve closing direction are mounted between the cylinder head 13 and retainers 27, 27 mounted at upper ends of the stems 25 protruding upwards from the guide tubes 26.

The intake valves VI, VI are opened and closed by an intake-side valve operating device 30, and the exhaust valves VE, VE are opened and closed by an exhaust-side valve operating device 31. A plug insertion tube 33 is disposed between both of the valve operating devices 30 and 31 to extend vertically for insertion of a spark plug 32 mounted in the cylinder head 13 to face the central portion of the combustion chamber 16, and is attached at its lower end to the cylinder head 13.

The intake-side valve operating device 30 includes first and second driving rocker arms 34 and 35 individually corresponding to the pair of intake valves VI, VI, a free rocker arm 36 capable of being freed relative to the driving rocker arms 34 and 35, i.e. , the intake valves VI, VI, an intake-side rocker shaft 37 on which the rocker arms 34, 35 and 36 are supported swingably, and an intake-side camshaft 38 rotatable about an axis parallel to the rocker shaft 37.

The exhaust-side valve operating device 31 includes first and second driving rocker arms 39 and 40 individually corresponding to the pair of exhaust valves VE, VE, a free rocker arm 41 capable of being freed relative to the driving rocker arms 39 and 40, i.e., the exhaust valves VE, VE, an exhaust-side rocker shaft 42 on which the rocker arms 39, 40 and 41 are supported swingably, and an exhaust-side camshaft 43 rotatable about an axis parallel to the rocker shaft 42.

The intake-side and exhaust-side rocker shafts 37 and 42 are fixedly supported by holder walls 44 provided on the cylinder head 13 between the adjacent cylinders. The intake-side and exhaust-side camshafts 38 and 43 are operatively connected at a reduction ratio of ½ to a crankshaft (not shown) and rotatably supported by the holder walls 44 and cam holders 45 fastened to upper ends of the holder walls 44.

The intake-side and exhaust-side valve operating devices 30 and 31 have basically the same construction and hence, the construction and operation of the intake-side valve operating device will be described in detail, and the description of the exhaust-side valve operating device 31 is omitted.

Provided on the intake-side camshaft 38 are a high-speed cam 47, and low-speed cams 46, 46 disposed on opposite sides of the high-speed cam 47 in correspondence to the intake valves VI, respectively.

Figure 3:
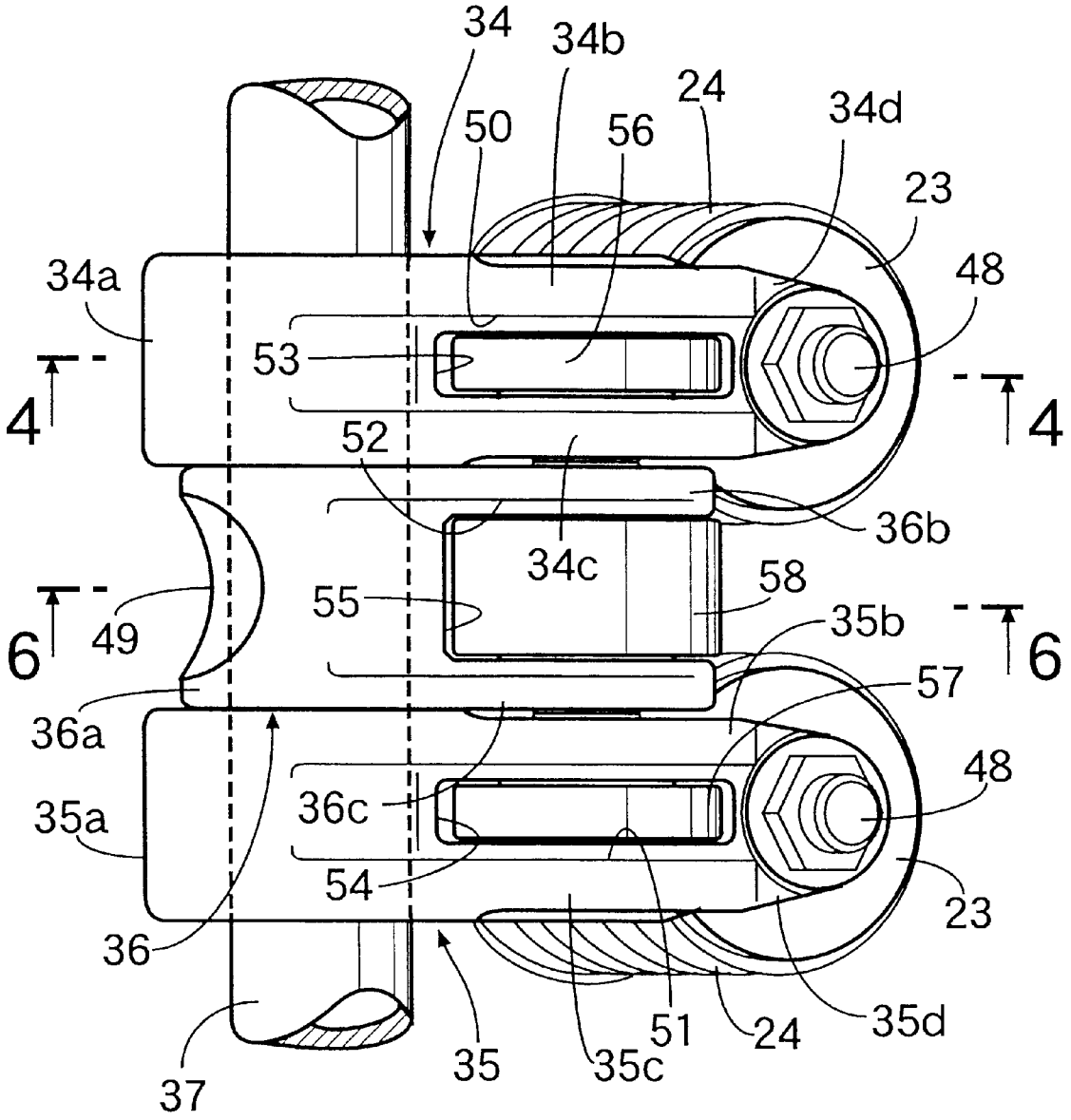

Referring to FIG. 3, the first driving rocker arm 34, the second driving rocker arm 35 and the free rocker arm 36 are formed of an aluminum alloy, for example, for the purpose of providing a reduction in weight, with their surfaces subjected to an anodizing treatment, and are disposed adjacent one another in such a manner that the free rocker arm 36 is sandwiched between the first and second driving rocker arms 34 and 35, and further, they are swingably supported commonly on the intake-side rocker shaft 37.

Each of the first and second driving rocker arms 34 and 35 and the free rocker arm 36 includes a cylindrical swinging support portion 34*a*, 35*a*, 36*a* swingably carried on the intake-side rocker shaft 37 at a base end thereof, and first and second support walls 34*b*, 34*c*; 35*b*, 35*c*; 36*b*, 36*c* which are opposed to each other and provided at locations spaced apart from each other in a direction along an axis of the intakeside rocker shaft 37 to extend from the swinging support portion 34*a*, 35*a*, 36*a*. Tip ends of the first and second support walls 34*b*, 34*c*; 35*b*, 35*c* of the first and second driving rocker arms 34 and 35 are connected to each other by connecting portions 34*d* and 35*d*, respectively.

Figure 4:
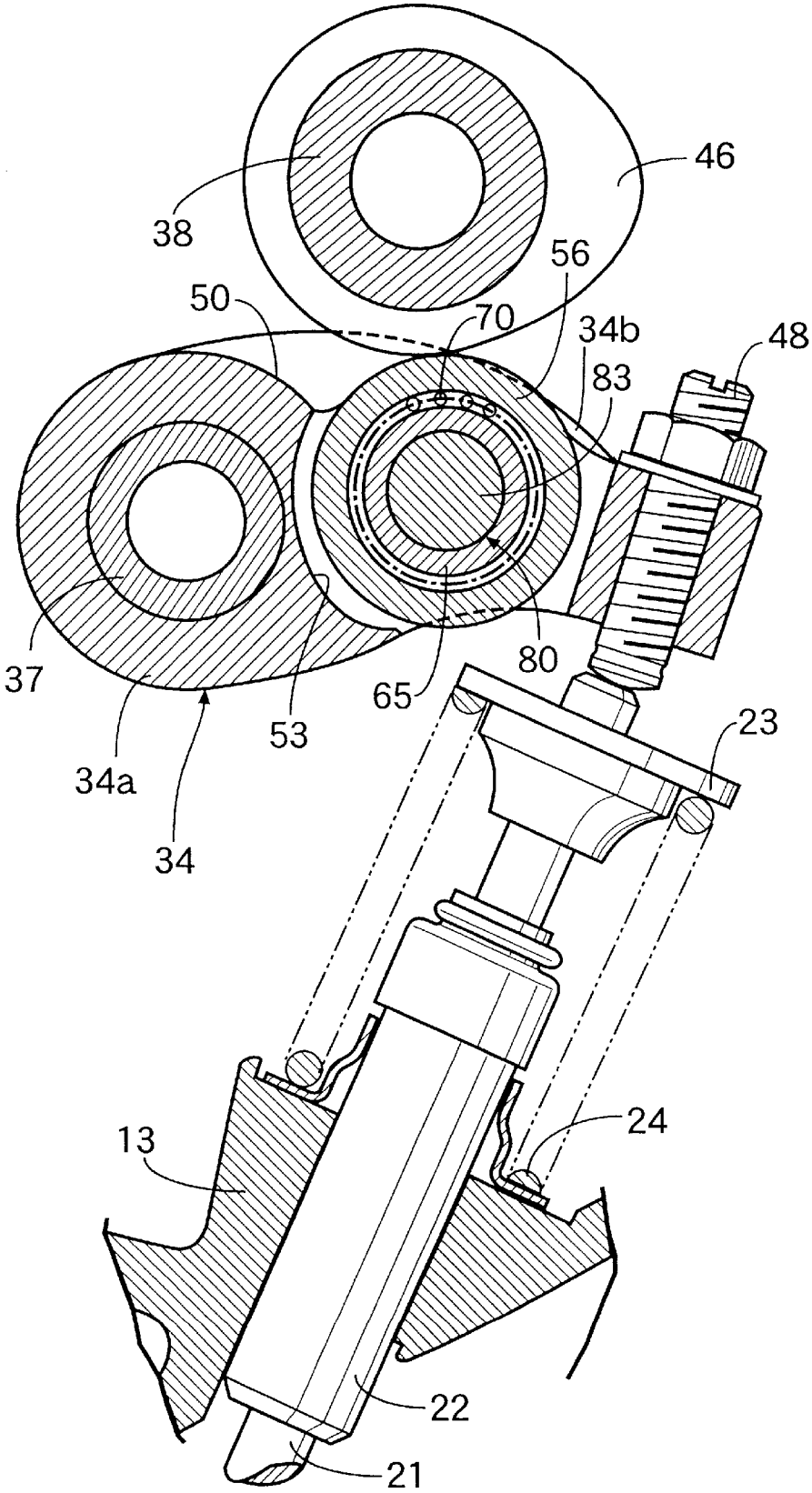

Referring also to FIG. 4, tappet screws 48, 48 are threadedly fitted for advancing and retracting movements into the connections 34*d* and 35*d* at the tip ends of the first and second driving rocker arms 34 and 35 to abut against the upper ends of the stems 21 of the intake valves VI, VI.

An arcuate notch 49 is provided in a portion of the swinging support portion 36*a* of the free rocker arm 36 corresponding to the plug insertion tube 33 so as to be recessed on a side opposite from the plug insertion tube 33, in order to enable the plug insertion tube 33 to be disposed in proximity to the free rocker arm 36.

Figure 5:
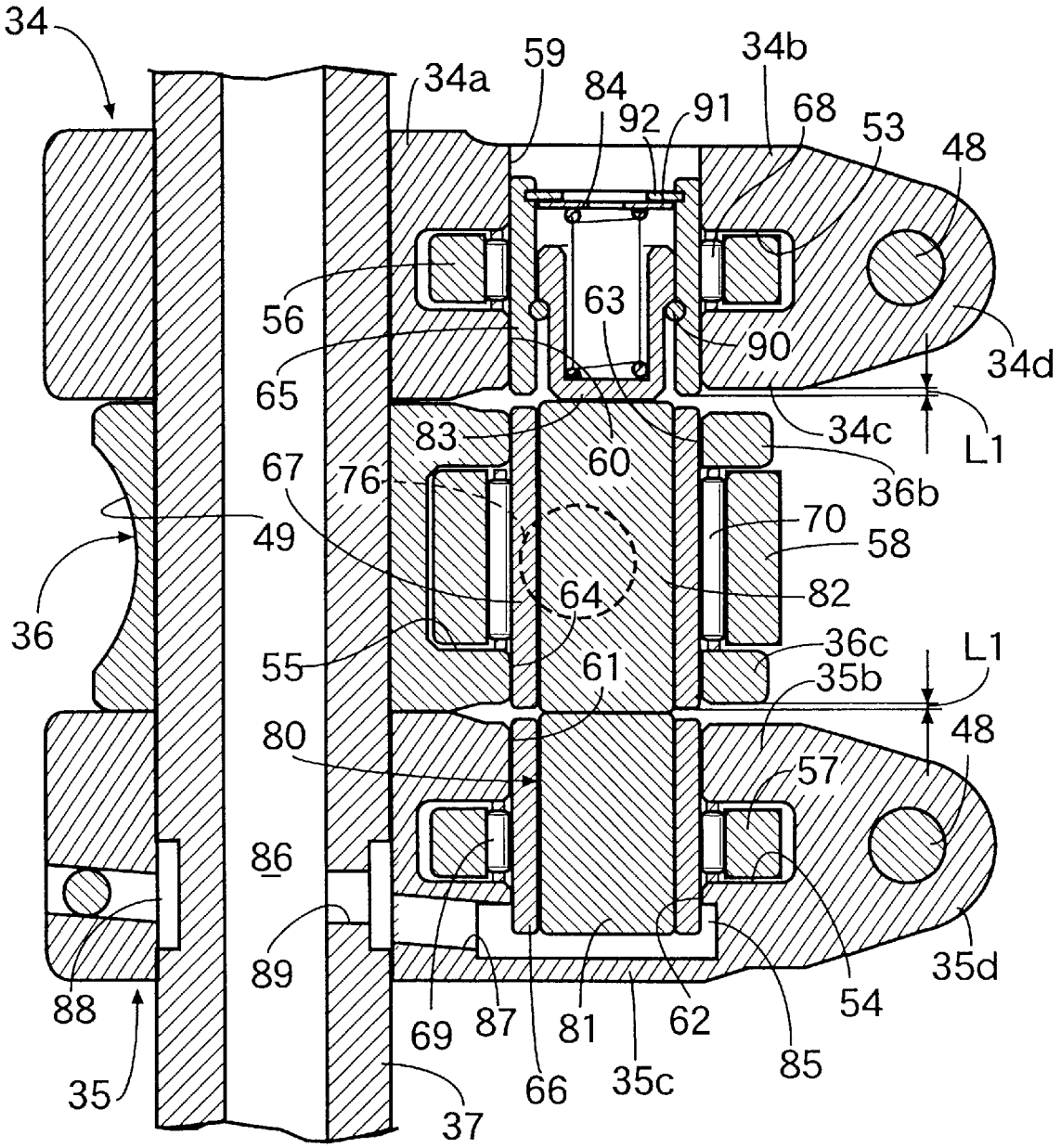
Figure 6:
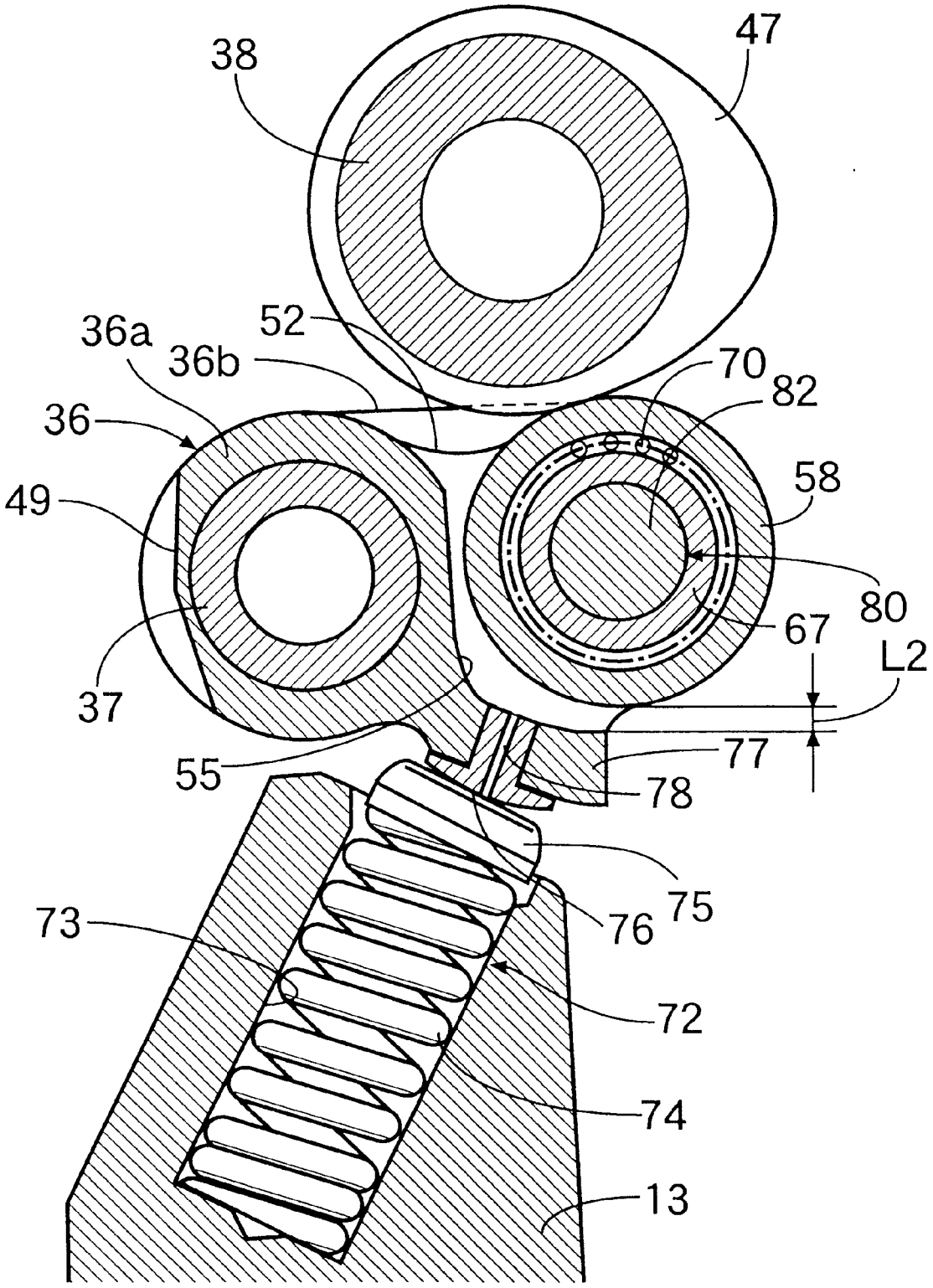

Referring also to FIGS.5 and 6, a recess 50 is defined between the support walls 34*b* and 34*c* on the upper surface of the first driving rocker arm 34; a recess 51 is defined between the support walls 35*b* and 35*c* on the upper surface of the second driving rocker arm 35, and a recess 52 is defined between the support walls 36*b* and 36*c* on the upper surface of the free rocker arm 36. Moreover, openings 53 and 54 are provided in the central portions of the recesses 50 and 51 in the first and second driving rocker arms 34 and 35 to open vertically, and an opening 55 is provided in the central portion of the recess 52 in the free rocker arm 36 to open on a side opposite from the intake-side rocker shaft 37 and upwards.

Rollers 56 and 57 are rotatably carried on the first and second driving rocker arms 34 and 35 and disposed in the openings 53 and 54 to come into rolling contact with the low-speed cams 46, 46, respectively, and a roller 58 is rotatably carried on the free rocker arm 36 and disposed in the opening 55 to come into rolling contact with the high-speed cam 47. Thus, an oil can be accumulated in the recesses 50, 51 and 52 in the rocker arms 34, 35 and 36. Each of the recesses 50, 51 and 52 is defined to be able to guide the oil toward each of the rollers 56, 57 and 58, and passages are provided for smoothly guiding the oil from the recesses 50, 51 and 52 to the rollers 56, 57 and 58, so that the rollers 56, 57 and 58 can be lubricated effectively.

Moreover, the width of each of the low-speed cams 46, 46 in a direction along the axis of the intake-side rocker shaft 37 is set at a value equal to or smaller than a distance between the first and second support walls 34*b*, 34*c* and 35*b*, 35*c* of the first and second driving rocker arms 34 and 35, and the width of the high-speed cam 47 in the direction along the axis of the intake-side rocker shaft 37 is set at a value equal to or smaller than a distance between the first and second support walls 36*b* and 36*c* of the free rocker arm 36. Lower portions of the low-speed cams 46, 46 are accommodated in the recesses 50, 51 with their portions of contact with the rollers 56, 57 being located below the upper ends of the first and second support walls 34*b*, 34*c*; 35*b*, 35*c* . A lower portion of the high-speed cam 47 is accommodated in the recess 52 with its portion of contact with the roller 58 being located below the upper ends of the first and second support walls 36*b* and 36*c* .

Through-bores 59 and 60 each having an axis parallel to the axis of the intake-side rocker shaft 37 are coaxially provided in the first and second support walls 34*b* and 34*c* of the first driving rocker arm 34. A through-bore 61 having an axis parallel to the axis of the intake-side rocker shaft 37 is provided in the first support wall 35*b* of the second driving rocker arm 35, and a bottomed bore 62 closed on a side opposite from the free rocker arm 36 is provided coaxially with the through-bore 61 in the second support wall 35*c*. Further, through-bores 63 and 64 each having an axis parallel to the axis of the intake-side rocker shaft 37 are coaxially provided in the first and second support walls 36*b* and 36*c* of the free rocker arm 36.

A cylindrical roller shaft 65 is fixed in the first driving rocker arm 34 by press-fitting in the through-bores 59 and 60, and made of a material harder than that of the first driving rocker arm 34, i.e., an iron-based material, for example, when the first driving rocker arm 34 is made of an aluminum alloy. A cylindrical roller shaft 66 is fixed in the second driving rocker arm 35 by press-fitting in the through-bore 61 and the bottomed bore 62, and made of a material having a hardness larger than that of the second driving rocker arm 35, i.e., an iron-based material, for example, when the second driving rocker arm 35 is made of an aluminum alloy. A cylindrical roller shaft 67 is fixed in the free rocker arm 36 by press-fitting in the through-bores 63 and 64, and made of a material having a hardness larger than that of the free rocker arm 36, i.e., an iron-based material, for example, when the free rocker arm 36 is made of an aluminum alloy.

The roller shafts 65, 66 and 67 are formed into cylindrical shapes with the same inside diameter, and needle bearings 68, 69 and 70 are interposed between the roller shafts 65, 66 and 67 and the rollers 56, 57 and 58, respectively.

Figure 7:
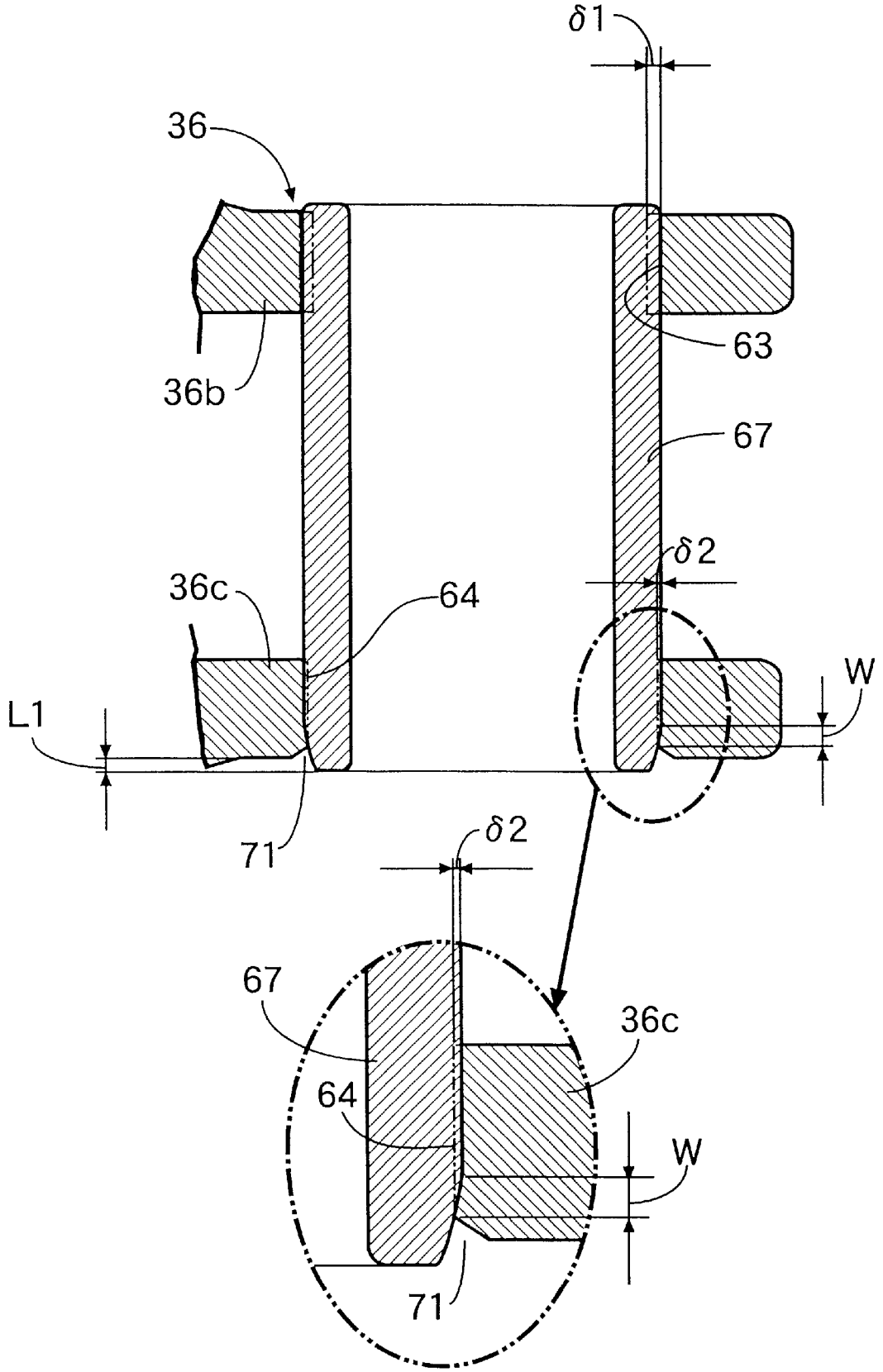

Referring to FIG. 7, in the press-fitting of the roller shaft 67 in the through-bores 63 and 64 in the free rocker arm 36, a press-fit margin 61 for the roller shaft 67 press-fitted in the through-bore 63 in the first support wall 36*b* is set larger than the maximum value of a press-fit margin $\delta 2$ for the roller shaft 67 press-fitted in the through-bore 64 in the second support wall 36*c* of the first and second support walls 36*b* and 36*c*, which is disposed adjacent the second driving rocker arm 36. Moreover, the press-fit margin $\delta 2$ for the roller shaft 67 press-fitted in the through-bore 64 in the second support wall 36*c* is set larger at an inner end of the through-bore 64, i.e., at a location on the side of the roller 58, than at an outer end of the through-bore 64, i.e., at a location on the side of the second driving rocker arm 35. In a region W of the through-bore 64 established on the side of the second driving rocker arm 35, the press-fit margin $\delta 2$ is set so as to be smaller at an outer location in the through-bore 64, i.e., at a location closer to the second driving rocker arm 35. Such a variation in press-fit margin in an axial direction of the through-bore 64 in the second support wall 36*b* is achieved by forming an outer periphery of the end of the roller shaft 67 adjacent the second driving rocker arm 35 into an outward bulged curved shape, for example. A tapered chamfer is provided at an outer end edge of the through-bore 64, and an annular clearance 71 is defined between an outer end of the through-bore 64 and the roller shaft 67.

At least one of axially opposite end surfaces of the roller shaft 67 adjacent the second driving rocker arm 35 protrudes by an amount L1 from a side surface of the free rocker arm 36 adjacent the second driving rocker arm 35.

The roller shaft 65 is press-fitted in the through-bores 59 and 60 in the first driving rocker arm 34 in a structure similar to a structure in which the roller shaft 67 is press-fitted in the through-bores 63 and 64 in the free rocker arm 36. At least one of axially opposite end surfaces of the roller shaft 65 adjacent the free rocker arm 36 protrudes by an amount L1 from a side surface of the first driving rocker arm 34 adjacent the free rocker arm 36.

Referring carefully to FIG. 6, a lost motion mechanism 72 is provided with the cylinder head 13 below the free rocker arm 36 and operable to apply a spring force to the free rocker arm 36 in a direction to bring the roller 58 of the free rocker arm 36 into rolling contact with the high-speed cam 47. The lost motion mechanism 72 is comprised of a spring 74 which is accommodated in a bottomed slide bore 73 provided in the cylinder head 13 with its upper portion opened and is received at one end thereof in a closed lower end of the slide bore 73, and a lifter 75 connected to the other end of the spring 74.

On the other hand, the free rocker arm 36 has a receiving portion 76 provided in contact with an upper end of the lifter 75 to receive the spring force from the lost motion mechanism 72. The receiving portion 76 is provided at a connection wall 77 connecting lower portions of the tip ends of the first and second support walls 36*b* and 36*c* provided on the free rocker arm 36, so as to substantially correspond to the axially central portion of the roller 58 supported on the free rocker arm 36. In the present embodiment, the free rocker arm 36 is made of a relatively soft aluminum alloy and hence, the receiving portion 76 is formed by securing a member made of a hard material such as an iron-based material to the connection wall 77, and thus, it is possible to reduce the wear of the receiving portion 76, while maintaining the rigidity of the latter. Alternatively, if the free rocker arm 36 is made of a hard material, then the receiving portion 76 may be formed integrally on the connection wall 77. An oil passage 78 is provided in the receiving portion 76 between its inner and outer surfaces.

Moreover, the connection wall 77 extends below the roller 58, and a distance L2 between the tip end of the connection wall 77 and the roller 58 is set smaller than a distance between an intermediate portion of the connection wall 77 and the roller 58. Namely, the connection wall 77 extending below the roller 58 is formed so that the distance between the connection wall 77 and the roller 58 is decreased toward the lowermost portion of the roller 58.

An associative-operation switchover means 80 is provided between the first and second driving rocker arms 34 and 35 and the free rocker arm 36 for switching over a state in which the rocker arms 34, 35 and 36 are operated in association with one another and a state in which the associative operation of the rocker arms 34, 35 and 36 is released. The associative-operation switchover means 80 includes a first switchover pin 81 capable of switching over the associative operation of the second driving rocker arm 35 and the free rocker arm 36 adjacent each other, and the releasing of such associative operation, a second cylindrical switchover pin 82 capable of switching over the associative operation of the free rocker arm 36 and the first driving rocker arm 34 adjacent each other, and the releasing of such associative operation, a limiting member 83 mounted in contact with the second switchover pin 82 on a side opposite from the first switchover pin 81, and a coiled return spring 84 for biasing the limiting member 83 toward the second switchover pin 82. The switchover pins 81 and 82 and the limiting member 83 are made of the same hard material as that for the roller shafts 65, 66 and 67.

The first switchover pin 81 is slidably fitted into the roller shaft 66 of the second driving rocker arm 35, and a hydraulic pressure chamber 85 is defined between the closed end of the bottomed bore 62 having the roller shaft 66 press-fitted therein and the first switchover pin 81. An oil passage 86 is provided coaxially, for example, in the intake-side rocker shaft 37 and connected to a hydraulic pressure source through a control valve (not shown), and an annular passage 88 is provided between the second driving rocker arm 35 and the intake-side rocker shaft 37 to lead to a communication passage 87 which is provided in the second support wall 35*c* of the second driving rocker arm 35 with one end thereof leading to the hydraulic pressure chamber 85. A communication bore 89 is provided in the intake-side rocker shaft 37 to permit the communication between the annular passage 88 and the oil passage 86.

The second switchover pin 82 is slidably received in the roller shaft 67 of the free rocker arm 36, and the first and second switchover pins 81 and 82 are in contact with each other, so that they can be slid on each other.

The limiting member 83 is formed into a bottomed cylindrical shape and slidably received in the roller shaft 65 of the first driving rocker arm 34, so that the closed end of the limiting member 83 is in contact with the second switchover pin 82 for sliding movement on each other. A retaining ring 90 is mounted to an inner surface of the roller shaft 65 to abut against the limiting member 83 for inhibiting the removal of the limiting member 83 from the roller shaft 65.

A ring-shaped washer 91 is inserted into an outer end of the roller shaft 65, and a retaining ring 92 is mounted to the inner surface of the roller shaft 65 to engage an outer surface of the washer 91. The return spring 84 is mounted between the limiting member 83 and the washer 91.

In such associative-operation switchover means 80, in a low-speed operational range of the engine, the hydraulic pressure in the hydraulic pressure chamber 85 is relatively low, and contact surfaces of the first and second switchover pins 81 and 82 are at a location corresponding to a location between the second driving rocker arm 35 and the free rocker arm 36, while contact surfaces of the second switchover pin 82 and the limiting member 83 are at a location corresponding to a location between the free rocker arm 36 and the first driving rocker arm 34. Therefore, the rocker arms 34, 35 and 36 are in relatively swingable states, whereby the intake valves VI, VI are opened and closed with timing and a lift amount depending on the low-speed cams 46, 46.

In a high-speed operational range of the engine, a relatively high hydraulic pressure is applied to the hydraulic pressure chamber 85, whereby the first switchover pin 81 is slidably fitted into the roller shaft 67 of the free rocker arm 36, while urging the second switchover pin 82, and the second switchover pin 82 is slidably fitted into the roller shaft 65 of the first driving rocker arm 34, while urging the limiting member 83. Therefore, the rocker arms 34, 35 and 36 are brought into integrally connected states, whereby the intake valves VI, VI are opened and closed with timing and a lift amount depending on the high-speed cam 47.

The operation of the first embodiment will be described below. The rocker arms 34, 35 and 36 in the intake-side valve operating device 30 have swinging support portions 34*a* , 35*a* and 36*a* swingably carried on the intake-side rocker shaft 37, and the first and second support walls 34*b*, 34*c*; 35*b*, 35*c*; 36*b*, 36*c* provided to extend from the swinging support portions 34*a*, 35*a* and 36*a* , respectively, and the recesses 50, 51 and 52 are defined between the support walls 34*b*, 34*c*; 35*b*, 35*c*; 36*b*, 36*c* on the upper surfaces of the rocker arms 34, 35 and 36. Moreover, the rollers 56, 57 and 58 are disposed in the central portions of the recesses 50, 51 and 52 to come into rolling contact with the low-speed cams 46, 46 and the high-speed cam 47 on the intake-side camshaft 38, respectively, and the cams 46, 46 and 47 are partially accommodated in the recesses 50, 51 and 52 to come into contact with the rollers 56, 57 and 58 below the upper ends of the support walls 34*b*, 34*c*; 35*b*, 35*c*; 36*b*, 36*c*.

Therefore, the intake-side camshaft 38 can be disposed in proximity to the rocker arms 34, 35 and 36, and the degree of freedom of the layout of the rocker arms 34, 35 and 36 and the intake-side camshaft 38 can be increased to provide a reduction in size of the entire engine. In addition, the support walls 34*b*, 34*c*; 35*b*, 35*c*; 36*b*, 36*c* on the opposite sides of the recesses 50, 51 and 52 act as reinforcing ribs, thereby enhancing the rigidity of supporting of the swinging support portions 34*a*, 35*a* and 36*a* on the intake-side rocker shaft 37. Moreover, the rollers 56, 57 and 58 can be lubricated by guiding the oil accumulated in the recesses 50, 51 and 52 to the rollers 56, 57 and 58.

It should be noted here that the spring force is applied to the free rocker arm 36 of the rocker arms 34, 35 and 36 capable of being freed relative to the intake valves VI, VI to urge the free rocker arm 36 toward the high-speed cam 47 corresponding to the free rocker arm 36 by the lost motion mechanism 72. The support walls 36*b* and 36*c* of the free rocker arm 36 are interconnected by the connection wall 77, and the receiving portion 76 is provided, in contact with the lifter 75 of the lost motion mechanism 72, on the connecting wall 77 substantially in correspondence to the axially central portion of the roller 58 supported on the free rocker arm 36.

Therefore, a point of a load applied from the high-speed cam 47 to the free rocker arm 36 and a point of the urging force applied from the lost motion mechanism 72 to the free rocker arm 36 cannot be displaced largely in the axial direction of the roller 58, thereby enabling the stable swinging supporting of the free rocker arm 36. In addition, the first and second support walls 36*b* and 36*c* are interconnected by the connection wall 77 and hence, the rigidity of supporting of the roller 58 rotatably supported between the support walls 36*b* and 36*c* can be enhanced.

Moreover, the connection wall 77 is disposed below the roller 58 and formed into the shape such that the distance between the connection wall 77 and the roller 58 is decreased toward the lowermost portion of the roller 58. Therefore, the oil can be retained between the roller 58 and the connection wall 77, thereby lubricating the roller 58 by the oil. Additionally, the oil passage 78 is provided in the receiving portion 76 to extend between the inner and outer surfaces of the receiving portion 76, so that the oil retained between the roller 58 and the connection wall 77 can be guided to contact portions of the lifter 75 of the lost motion mechanism 72 and the receiving portion 76 to contribute to a reduction in wear at the contact portions.

The rollers 56, 57 and 58 in rolling contact with the low-speed cams 46, 46 and the high-speed cam 47 on the intake-side camshaft 38 are rotatably carried on the cylindrical roller shafts 65, 66 and 67 fixed to the rocker arms 34, 35 and 36 with needle bearings 68, 69 and 70 interposed therebetween, respectively. When the associative-operation switchover means 80 is operated from the associative-operation releasing state to the associatively operating state, the first and second switchover pins 81 and 82 of the associative-operation switchover means 80 are slidably fitted into the roller shaft 67 of the free rocker arm 36 and the roller shaft 65 of the first driving rocker arm 34, respectively. Namely, the second driving rocker arm 35 and the free rocker arm 36 are connected to each other by the first switchover pin 81 located astride between the second driving rocker arm 35 and the free rocker arm 36, and the free rocker arm 36 and the second driving rocker arm 34 are connected to each other by the second switchover pin 82 located astride between the free rocker arm 36 and the second driving rocker arm 34.

The roller shafts 67 and 65 are made of the material harder than those the free rocker arm 36 and the first driving rocker arm 34, and at least one of the axially opposite end surfaces of each of the roller shafts 67 and 65 receiving each of the first and second switchover pins 81 and 82 protrudes from each of the rocker arms 36 and 34. More specifically, in the free rocker 36, the end surface of the roller shaft 67 adjacent the second driving rocker arm 35 protrudes from the side surface of the free rocker arm 36 toward the second driving rocker arm 35, and in the first driving rocker arm 34, the end surface of the roller shaft 65 adjacent the free rocker arm 36 protrudes from the side surface of the first driving rocker arm 34.

Therefore, even if the hydraulic pressure force in the hydraulic pressure chamber 85 is varied during relatively swinging movements of the adjacent rocker arms 36 and 35; 34 and 36 with the association-operation switchover means 80 brought into the associative-operation releasing state, the end surfaces of the first and second switchover pins 81 and 82 cannot be brought into sliding contact with the side surfaces of the free rocker arm 36 and the first driving rocker arm 34, but remain in sliding contact with the end surfaces of the roller shafts 67 and 65. Moreover, the roller shafts 67 and 65 are made of the material harder than that for the free rocker arm 36 and the first driving rocker arm 34 and hence, it is possible to prevent the generation of a wear powder due to the sliding contact of the switchover pins 81 and 82 with the roller shafts 67 and 65 to the utmost, so that the wear powder cannot enter into the roller shafts 67 and 65, thereby ensuring the smooth switching-over operation of the switchover pins 81 and 82, i.e., the smooth switching-over operation of the association-operation switchover means 80.

Further, the outer surfaces of the free rocker arm 36 and the first driving rocker arm 34 formed of the aluminum alloy have been subjected to the anodizing treatment, and the sliding contact of these rocker arms 36 and 34 with the switchover pins 81 and 82 need not be taken into consideration. Therefore, it is possible to prevent the corrosion of the free rocker arm 36 and the first driving rocker arm 34, while retaining a film produced by the anodizing treatment. The second driving rocker arm 35 originally has no possibility of being brought into contact with the switchover pins 81 and 82, and even if the second driving rocker arm 35 is subjected to the anodizing treatment, the prevention of the corrosion cannot be impeded.

Moreover, each of the roller shafts 65, 66 and 67 is press-fitted into at least one, e.g., both in the embodiment, of the first and second support walls 34*b*, 34*c*; 35*b*, 35*c*; 36*b*, 36*c* included in each of the rocker arms 34, 35 and 36. Therefore, parts other than the roller shafts 65, 66 and 67 are not required for the purpose of fixing the roller shafts 65, 66 and 67, thereby avoiding an increase in number of parts and an increase of processing steps and at the same time, the roller shafts 65, 66 and 67 can be fixed easily to the rocker arms 34, 35 and 36.

A portion of the roller shaft 67 adjacent the second support wall 36*c* in the free rocker arm 36 and a portion of the roller shaft 65 adjacent the second support wall 34*c* in the first driving rocker arm 34 are portions receiving the first and second switchover pins 81 and 82 of the associative-operation switchover means 80 from the sides of the first driving rocker arm 35 and the free rocker arm 36, and the press-fit margins for the roller shafts 67 and 65 press-fitted into the second support walls 36*c* and 34*c* on the sides of the second driving rocker arm 35 and the free rocker arm 36 are set smaller than those for the roller shafts 67 and 65 press-fitted into the second support walls 36*c* and 34*c* on the sides of the rollers 58 and 56.

Therefore, it is possible to suppress the deformation of the ends of the roller shafts 67 and 65 receiving the first and second switchover pins 81 and 82 due to the press-fitting to a small level, and to smoothen press-fitting of the first and second switchover pins 81 and 82 into the roller shafts 67 and 65, thereby smoothening the switching-over between the associative operation of the adjacent rocker arms 35 and 36; 36 and 34 and the releasing of the associative operation by the switchover pins 81 and 82.

Moreover, the press-fit margins for portions of the roller shafts 67 and 65 press-fitted into the second support walls 36*c* and 34*c* in that portion of an press-fit area which is on the sides of the second driving rocker arm 35 and the free rocker arm 36 are set so as to be decreased gradually as being closer to the second driving rocker arm 35 and the free rocker arm 36. Therefore, the deformation of the ends of the roller shafts 67 and 65 due to the press-fitting is decreased toward the second driving rocker arm 35 and the free rocker arm 36 and thus, it is possible to further smoothen the press-fitting of the switchover pins 81 and 82 into the roller shafts 67 and 65 to further smoothen the switching-over between the associative operation and the releasing of the associative operation.

In the present embodiment, the end surface of the roller shaft 67 adjacent the second driving rocker arm 35 and the end surface of the roller shaft 65 adjacent the free rocker arm 36 protrude from the free rocker arm 36 and the first driving rocker arm 34, and the annular clearances 71 are created between the outer ends of the second support walls 36*c* and 34*c* and the roller shafts 67 and 65. Therefore, it is possible to avoid the application of a stress to the ends of the roller shafts 67 and 65 adjacent the second driving rocker arm 35 and the free rocker arm 36 and to further decrease the deformation to further smoothen the switching-over between the associative operation and the releasing of the associative operation by the switchover pins 81 and 82.

Further, the roller shafts 67 and 65 are press-fitted into the first and second support walls 36*b*, 36*c* ; 34*b*, 34*c* with the press-fit margin in the first support walls 36*b* and 34*b* larger than the press-fit margin in the second support walls 36*c* and 34*c* . This also makes it possible to suppress the deformation of the ends of the roller shafts 67 and 65 receiving the switchover pins 81 and 82 due to the press-fitting to a small level to smoothen the switching-over between the associative operation and the releasing of the associative operation, and to facilitate the press-fitting operation for the roller shafts 67 and 65 by press-fitting the roller shafts 67 and 65 from the outside of the second support walls 36*c* and 34*c* .

In the first driving rocker arm 34 disposed at one end in a direction of arrangement of the rocker arms 34, 35 and 36, the through-bores 59 and 60 are coaxially provided in the first and second support walls 34*b* and 34*c* included in the first driving rocker arm 34, so that the opposite ends of the roller shaft 65 are press-fitted into these through-bores, and the washer 91 receiving the return spring 84 of the associative-operation switchover means 80 is mounted to the roller shaft 65.

Therefore, as compared with a system in which a bottomed hole must be drilled in the first support wall 34*b*, it is unnecessary to subject the closed end of the bottomed hole to a relieving treatment, and it is possible to facilitate the drilling of the first support wall 34*b*, while enabling a reduction in size of the first driving rocker arm 34, and to reduce the weight of the first driving rocker arm 34 by an amount corresponding to an end wall which is not required. Moreover, in a case where the intake-side rocker shaft 37 and the roller shaft 65 are parallel to each other as in the present embodiment, a distance between the axes of the intake-side rocker shaft 37 and the roller shaft 65 in the first and second support walls 34*b* and 34*c* can be accurately determined.

Furthermore, the washer 91 is inserted into the roller shaft 65 with its outer surface engaged with the retaining ring 92 mounted to the inner surface of the roller shaft 65 and hence, the washer 91 is easily mounted to the roller shaft 65. In addition, by setting the inside diameter of the washer 91 at a relatively large value, the inside of the roller shaft 65 can be visually observed from the outside, and it can be confirmed from the outside whether the return spring 84 is accommodated correctly within the roller shaft 65.

Figure 8:
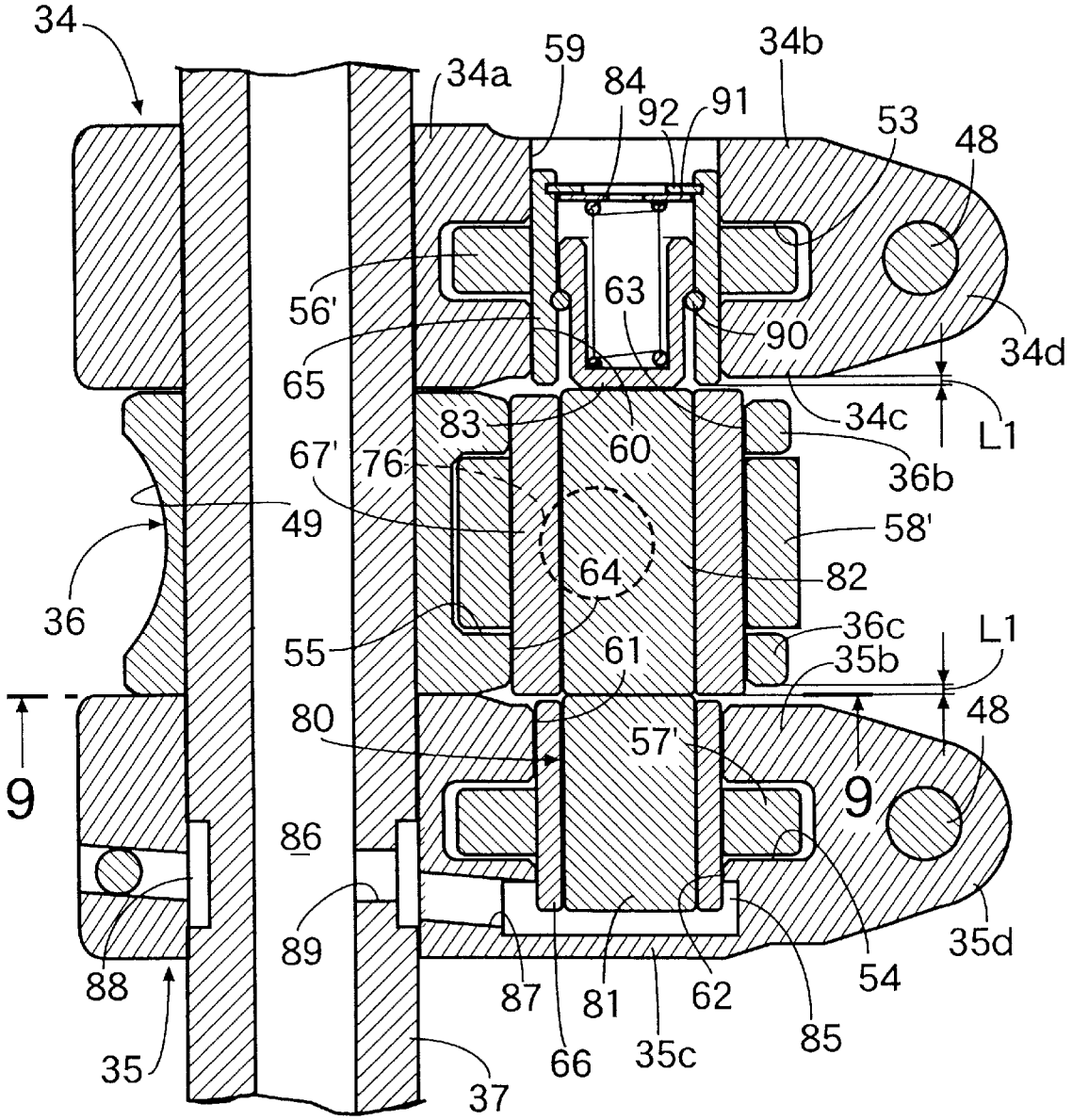
FIG. 8 is a sectional view similar to FIG. 4, but according to a second embodiment of the present invention.
Figure 9:
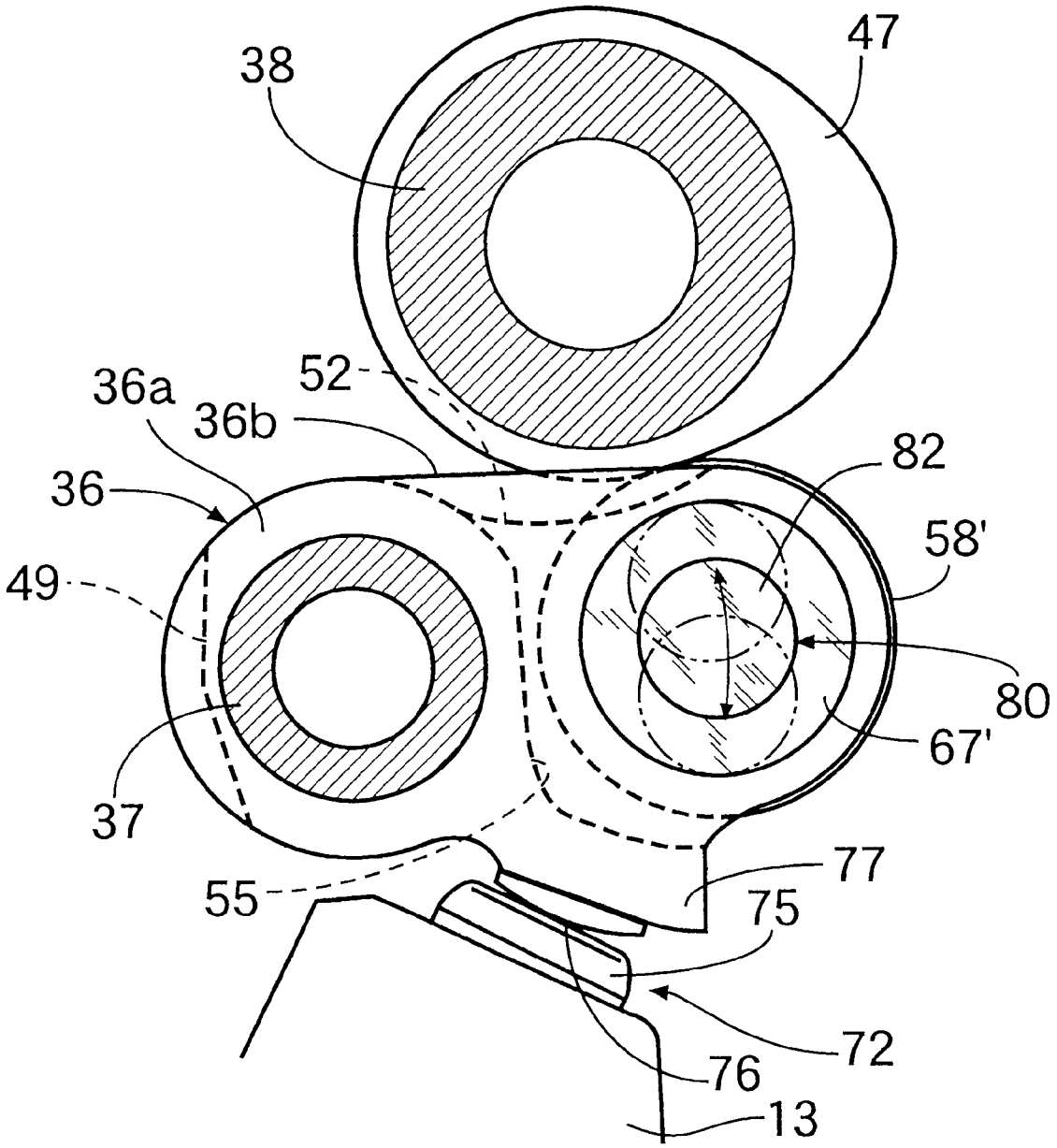
FIG. 9 is a sectional view taken along a line 9—9 in FIG. 8.

FIGS. 8 and 9 show a second embodiment of the present invention. FIG. 8 is a sectional view similar to FIG.4, and FIG. 9 is a sectional view taken along a line 9—9 in FIG. 8.

Cylindrical roller shafts 65, 66 and 67' are press-fitted into the rocker arms 34, 35 and 36 and each made of a material harder than those of the rocker arms 34, 35 and 36, and rollers 56', 57' and 58' are supported directly on the roller shafts 65, 66 and 67', respectively.

The roller shaft 67' press-fitted in the free rocker arm 36 is formed at an increased wall thickness such that its inside diameter is equal to those of the roller shafts 65 and 66 of the first and second driving rocker arms 34 and 35, but its outside diameter is larger than those of the roller shafts 65 and 66.

Moreover, the outside diameter of the roller shaft 67' is set so that a change in position of the first switchover pin 81 relative to the roller shaft 67' in response to the relative swinging movement of the second driving rocker arm 35 and the free rocker arm 36 with the first switchover pin 81 located at the associative-operation releasing position occurs within a range defined by an outer periphery of the roller shaft 67', as shown by a dashed line in FIG. 9.

In the second embodiment, during the relative swinging movement of the second driving rocker arm 35 and the free rocker arm 36, the change in relative position of the first switchover pin 81 relative to the roller shaft 67' occurs within the range defined by the outer periphery of the roller shaft 67'. Therefore, even if the hydraulic pressure force in the hydraulic pressure chamber 85 is varied, the end surface of the first switchover pin 81 cannot be separated from the end surface of the roller shaft 67' to come into sliding contact with the side surface of the free rocker arm 36. Moreover, the roller shaft 67' is made of the material harder than that of the free rocker arm 36 and hence, it is possible to prevent the generation of a wear powder due to the sliding contact of the roller shaft 67' and the first switchover pin 81 to the utmost, so that the wear powder cannot enter into the roller shaft 67', thereby ensuring the smooth switching-over operation of the first switchover pin 81.

In the second embodiment, the end surface of the roller shaft 67' adjacent the second driving rocker arm 35 protrudes from the side surface of the free rocker arm 36, but such protrusion is not an essential requirement, and alternatively, the end surface of the roller shaft 67' adjacent the second driving rocker arm 35 may be located at a location flush with the side surface of the free rocker arm 36. In addition, the rollers 56', 57' and 58' are supported directly on the roller shafts 65, 66 and 67' in the second embodiment, but bearings such as needle bearings may be interposed between the rollers 56', 57' and 58' and the roller shafts 65, 66 and 67'.

Although the embodiments of the present invention have been described in detail, it will be understood that the present invention is not limited to the above-described embodiments, and various modifications in design may be made without departing from the spirit and scope of the invention defined in claims.

What is claimed is:

1. A valve operating system in an internal combustion engine, comprising a switchover pin which is movable between an associatively operating position where adjacent ones of rocker arms are operated in association with each other, and an associative-operation releasing position where the associative-operation is released, said switchover pin receiving at axially opposite ends thereof a hydraulic pressure force acting toward the associatively operating position and a spring force acting toward the associative-operation releasing position, a cylindrical roller shaft which is fixed to one of the adjacent rocker arms, and into which said switchover pin is slidably fitted in response to the movement thereof toward said associatively operating position, and a roller rotatably carried on said roller shaft to come into rolling contact with a cam provided on a camshaft, wherein at least one of axially opposite end surfaces of said roller shaft formed of a material harder than that of said one rocker arm, which receives said switchover pin, protrudes from a side surface of said one rocker arm.

2. A valve operating system in an internal combustion engine according to claim 1, wherein an outside diameter of said roller shaft is set so that a change in position of said switchover pin relative to said roller shaft in response to the relative swinging movements of the adjacent rocker arms in a state in which said switchover pin is in the associative-operation releasing position, occurs within a range defined by an outer periphery of said roller shaft.

3. A valve operating system in an internal combustion engine, comprising a switchover pin which is movable between an associatively operating position where adjacent ones of rocker arms are operated in association with each other, and an associative-operation releasing position where the associative-operation is released, said switchover pin receiving at axially opposite ends thereof a hydraulic pressure force acting toward the associatively operating position and a spring force acting toward the associative-operation releasing position, a cylindrical roller shaft which is fixed to one of said adjacent rocker arms, and into which said switchover pin is slidably fitted in response to the movement thereof toward said associatively operating position, and a roller rotatably carried on said roller shaft to come into rolling contact with a cam provided on a camshaft, wherein an outside diameter of said roller shaft formed of a material harder than that of said one rocker arm is set so that a change in position of said switchover pin relative to said roller shaft in response to the relative swinging movements of the adjacent rocker arms in a state in which said switchover pin is in the associative-operation releasing position, occurs within a range defined by an outer periphery of said roller shaft.

* * * * *